United States Patent [19]

Olesen

[11] Patent Number: 4,950,892

[45] Date of Patent: Aug. 21, 1990

[54] METHOD AND TOOL FOR GRAVEL PACK EVALUATION

[75] Inventor: Jean-Remy Olesen, Sugarland, Tex.

[73] Assignee: Schlumberger Technology Corporation, Houston, Tex.

[21] Appl. No.: 322,795

[22] Filed: Mar. 13, 1989

[51] Int. Cl.[5] ..... G01V 5/10

[52] U.S. Cl. ..... 250/270; 250/269

[58] Field of Search ..... 250/270, 264, 265, 269

[56] References Cited

U.S. PATENT DOCUMENTS

| | | | |
|---|---|---|---|
| 2,991,364 | 7/1961 | Goodman . | |
| 3,379,882 | 4/1968 | Youmans . | |
| 3,781,545 | 12/1973 | Paap et al. | 250/270 |
| 4,232,220 | 11/1980 | Hertzog . | |
| 4,436,996 | 3/1984 | Arnold et al. . | |
| 4,459,480 | 7/1984 | Dimon . | |
| 4,587,423 | 5/1986 | Boyce . | |
| 4,783,995 | 11/1988 | Michel et al. . | |

OTHER PUBLICATIONS

Wichmann et al., "Advances in Nuclear Production Logging", Transaction SPWLA (1967).

*Primary Examiner*—Janice A. Howell
*Assistant Examiner*—Richard Hanig
*Attorney, Agent, or Firm*—Frederic C. Wagret; Henry N. Garrana

[57] ABSTRACT

A method for investigating a gravel pack located in the annulus between the tubing/screen and the casing of a borehole, comprising the steps of:

moving a logging tool through the tubing/screen over the depth region of the gravel pack, said logging tool including a neutron source able to emit neutrons at such an energy that their interaction with a first set of atoms indicative of the gravel pack quality causes the production of gamma rays, and at least one gamma ray detector; and deriving a measurement of the number of gamma rays resulting from the interaction of said neutrons and said first set of atoms of the gravel pack material, and which are detected by said detector over a predetermined counting time interval.

11 Claims, 4 Drawing Sheets

METHOD AND TOOL FOR GRAVEL PACK EVALUATION

BACKGROUND OF THE INVENTION

1. Technical Field

The present invention relates to gravel pack logging and, more particularly, to an improved method for providing a reliable quantitative evaluation of gravel pack quality.

2. Prior Art

Many oil wells are completed with internal gravel pack assemblies to prevent sand infiltration into the production tubing. A reliable method of evaluating the quality of the gravel pack in situ, at the time of its construction, is needed in order to improve the effectiveness of the gravel pack and to reduce the chances that a workover will be required later.

Prior investigations of this problem have indicated the applicability of wireline logging techniques to the evaluation of gravel packs. In a paper entitled "Gravel Pack Evaluation", first presented (Paper SPE 11232 at the 57th Annual Fall Technical Conference and Exhibition of the Society of Petroleum Engineers of AIME, New Orleans, LA, September, 1982, published Journal of Petroleum Technology, September, 1983, pp. 1611-1616, M.R. Neal described the responses of three well logging tools, the compensated neutron tool (neutron source and two neutron detectors), the nuclear fluid density meter tool (gamma ray source and one gamma ray detector), and the dual-spacing gamma ray tool (gamma ray source and two gamma ray detectors), to various gravel pack situations and showed that each tool responded well to changes in density of the material in the annulus between the screen (of the gravel pack hardware) and the casing. Although Neal's work provided useful qualitative information concerning gravel pack quality, it did not provide a procedure by which a quantitative evaluation could be made.

Further research by M.R. Neal and J.F. Carroll, as reported in a paper entitled "A Quantitative Approach to Gravel Pack Evaluation", 6th SPE of AIME Formation Damage Symposium, Bakersfield, CA, Feb. 13–14, 1984, demonstrated that tool response (count rate) could be directly related to the percent void space in the gravel pack, and led to the development of interpretive procedures for determining percent packing when field hardware is the same as that used for laboratory calibration measurements and for making a quick-look quantitative approximation when the well hardware differs from laboratory hardware.

Furthermore, it is known to use for investigating a gravel pack, a tool comprising a gamma ray source and a gamma ray detector, such as described in U.S. Pat. No. 4,587,423 issued to James R. Boyce on May 6, 1986.

Although such tools are satisfactory, they show some limitations.

Firstly, such known tools use a chemical nuclear radioactive source; any sticking of the tool in the well may have potential serious consequences on the environment, not to speak about the pecuniary point of view.

Secondly, in highly deviated wells and horizontal wells, gravel pack separates from completion fluid, owing to their respective different densities. Gravel pack material settles on the low side of the borehole, leaving the upper section of the borehole improperly packed. In view of obviating this natural trend, such wells are gravel packed with gravel pack and completion fluid having equal or similar density values. However, this entails that the gravel pack cannot be distinguished from completion fluid, since said known tools carry out density measurements; this prevents any effective measurements of gravel pack quality.

Thirdly, it is a constant preoccupation of one skilled in the art to decrease to the utmost the influence of the formation on the gravel pack measurements.

Fourthly, there is a general trend in the logging techniques to know better and better the gravel pack quality; in other words quantitative results are requested; e.g. in some occasion, the need occurs to locate accurately a pack region which has been partially emptied (following faults in the screen) and refilled with formation material.

OBJECTS OF THE INVENTION

It is a first object of the invention to provide a logging tool particularly safe with regard to the use of a nuclear device in subterranean formations.

A second object of the invention is to provide a logging tool which will give effective measurements in gravel packed wells in which gravel pack material density is close or equal to completion fluid density.

A third object of the invention is to provide a nuclear logging tool which allows one to carry out measurements representative of the gravel pack only, or at least to reduce substantially the influence of the formation surrounding the borehole.

A fourth object of the invention is to provide a nuclear tool which is able to distinguish, in certain cases, original pack from a pack zone which has been removed and refilled with formation material.

SUMMARY OF THE INVENTION

There is provided, according to the invention, a method for investigating a gravel pack located in the annulus between the tubing/screen and the casing of a borehole comprising the steps of:

moving a logging tool through the tubing/screen over the depth region of the gravel pack, said logging tool including a neutron source which emits neutrons at such an energy that their interaction with a first set of atoms representative of gravel pack material results in the production of gamma rays, and at least one gamma ray detector; and deriving a measurement of the number of gamma rays resulting from the interaction of said neutrons and said first set of atoms of the gravel pack material, and which are detected by said detector over a predetermined counting time interval.

Preferably, said first set of atoms includes aluminum (Al) and/or silicon (Si) atoms.

In a preferred embodiment, so as to reduce as much as possible the influence of the gamma rays resulting from the interaction between emitted neutrons and a second set of atoms which are not representative of the gravel pack, the tool is moved in the well at a speed related to the half life of the gamma rays characteristic of said second set of atoms.

Said second set of atoms includes oxygen ($O_{16}$) atoms.

The instant invention also contemplates a tool for investigating a gravel pack located in the annulus between the tubing/screen and the casing of a borehole, including;

a neutron source which emits neutrons at such an energy that their interaction with a first set of atoms representative of gravel pack material results in the production of gamma rays, at least one gamma ray detector, and means for counting gamma rays detected over a predetermined time interval.

DESCRIPTION OF THE PREPERRED EMBODIMENT

Figure 1:
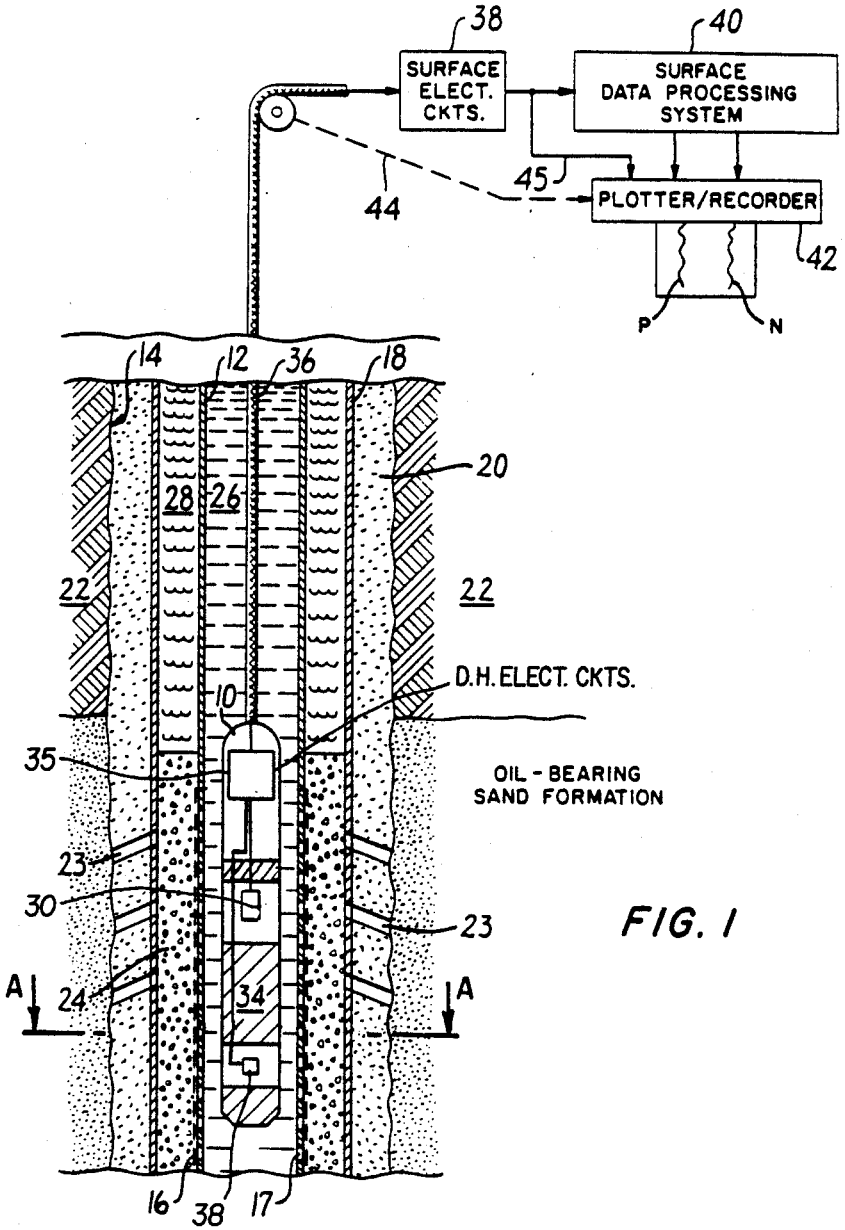
FIG. 1 is a schematic view of one embodiment of a well logging tool and associated surface processing components for implementing the improved gravel evaluation technique of the present invention.
Figure 2:
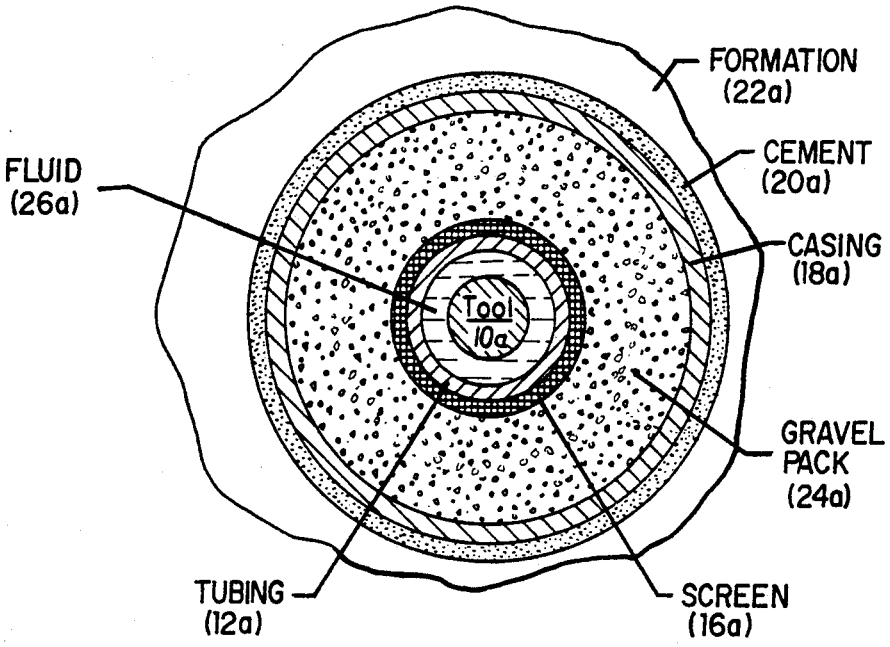
FIG. 2 is a horizontal cross section along line A-A of FIG. 1.

An illustrative embodiment of a gravel pack logging tool useful in practicing the present invention is shown in FIG. 1. The tool includes a temperature-and-pressure resistant sonde 10 that is adapted to be suspended in and moved through a production tubing string 12 located within a borehole 14. The tubing includes a gravel pack screen, which is indicated schematically at 16 and which may be conventional. Holes 17 are formed in the tubing 12 inside of the screen to admit oil to the tubing. The borehole is shown as completed, i.e., a casing 18 has been cemented 20 to the surrounding formations 22 and a gravel pack 24 has been constructed over the region of the screen 16. The casing 18 and cement annulus 20 have been perforated, as at 23, opposite the screen 16 to permit oil flow from the formations 22 to the tubing 12. Both the tubing 12 and the annulus between the tubing 12 and the casing 18 are shown as fluid-filled, as at 26 and 28, respectively.

The tool 10 includes an omnidirectional neutron generator 30 and at least one gamma ray detector 32 spaced therefrom and shielded, as at 34, against direct irradiation along the tool axis. The generator 30 is preferably of the electronic type (as opposed to a chemical source) and comprises a neutron emitter which may be of the type shown in U.S. Pat. No. 2,991,364 issued July 4, 1961 to Goodman. The detector 32 may also be conventional, such as a NaI scintillation detector. The reaction between the neutrons emitted by the generator 30 and gravel pack 24 (to which is directed the invention), is the so-called "activation" reaction, in which the incident neutrons transmute the nucleus of gravel pack atoms into an unstable state, which then decays back to a stable state in emitting gamma rays of different energies. The resulting detected signals are applied to downhole electronic circuits 35 for amplification, coding or the like for transmission to the earth's surface over an armored cable 36.

At the surface, the detected signals are received by electronic circuits 38, where they are decoded or otherwise converted and restored as required for further processing. Thereafter they are applied to the data processing system 40, which may comprise a digital apparatus, such as a PDP 11/34 manufactured by the Digital Equipment Corp., and specially modified, as by stored instructions, to carry out the present invention. As described hereinafter, the data processing system 40 generates a percent packing output P and a tool count rate output N which are applied to a plotter/recorder 42 for recording as a function of depth in the bore hole. The usual winch and depth-recording linkage, indicated schematically at 44, is provided for this purpose.

If desired, the derivation of percent packing may be carried out remotely, as would be the case, for instance, when a computer is not available at the well site. In that case, the detector signals from the circuits 38 could be applied directly to the recorder 42, as indicated by the line 45, and recorded on magnetic tape for subsequent transmission to the remote site.

The number of gamma rays detected by the detector 32 is an indication of the volume of the activated gravel pack material. A high volume of material causes more gamma rays to be produced than a low volume of material. In a gravel packed well everything remains constant except the annular space between the casing and the screen or tubing. This space can be totally filled with gravel, partially filled with gravel, or have void spaces containing no gravel. In each of these cases, the volume that is not filled with gravel is filled with some type of fluid of a known composition (usually called completion fluid).

In accordance with the present invention, an improved technique for the quantitative evaluation of gravel packs has been developed.

The neutron source 30 emits neutrons with 14 MeV energy, and can be of the pulsed type, although this feature is not compulsory for carrying out the invention. The emitted neutrons interact with atoms in the gravel pack and in the formation, and result, among others, in emission of gamma rays. The specific atoms to which the invention is directed are Si and Al atoms which are indicative of the gravel pack quality. In other words, the measurements are made so as to be responsive mainly to gamma rays coming from Si and Al atoms. Since the different gravel pack materials presently used include either Si (sand), or Al (bauxite) or both Si and Al, this allows good gravel pack quality measurements.

Moreover, the tool according to the invention has a rather shallow depth of investigation, thus reducing substantially the influence of the gamma rays resulting from the interaction between emitted neutrons and atoms of the formation. As a matter of fact, the probability of having neutrons of a given energy decreases rapidly with the distance from the source; the energy of a neutron is, after two collisions with Hydrogen atoms, a quarter ($\frac{1}{4}$) of the initial energy, i.e. 3.5 MeV, which is substantially lower than the threshold energy for activating Si atoms (4.5 MeV); actually, the highest probability of interaction between emitted neutrons and Si atoms occurs with neutrons of 9 MeV energy. Thus, the count of gamma rays generated by atoms of the formation is actually low.

Though not totally cancelled, the influence of the formation does not substantially affect the measurements. Variation in the formation results as a rule of thumb from the variation of concentration of Si and Al from one layer to the other. Since the tool is responsive to both Si and Al in the formation, the influence on the total counting of gamma rays of a given area of formation showing two successive layers of respectively shale (including Al) and sand (including Si) is reduced substantially to a constant.

Figure 3:
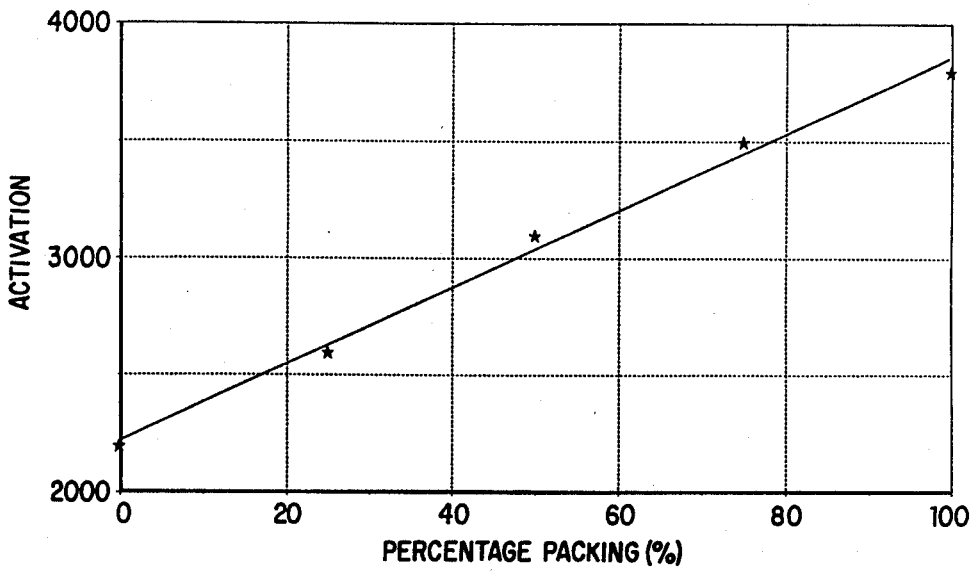
FIG. 3 graphically shows the variation of the gamma ray counts and the percentage of pack in the investigated area of the well.

FIG. 3 shows experimental results which contemplate a quite linear relationship between gamma counts and percentage packing which is characteristic of gravel pack quality.

Figure 4:
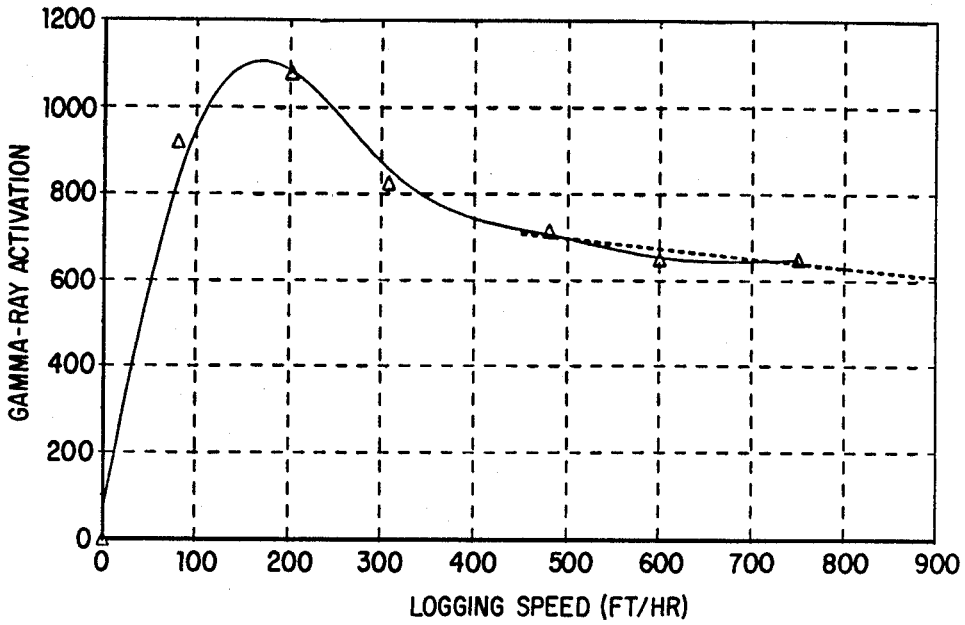
FIG. 4 graphically shows the variation of gamma ray counts as a function of the tool speed in the well.

Emitted neutrons may interact with many different atoms in the gravel pack material and in the formation, among others oxygen atoms ($O_{16}$). It is preferred to minimize or cancel the influence of such interaction in the counting of gamma rays coming from Si and Al atoms, i.e. the only ones which are representative of the gravel pack and thus the ones which should be taken into account. Emitted neutrons having an energy greater than 10 MeV are able to interact with $O_{16}$ atoms, which then transmutes to unstable $N_{16}$ atoms, which in turn decays back to $O_{16}$ in emitting 7 MeV gamma rays; such gamma rays should not be taken into account for the measurement. To this end, according to the invention, the tool is moved through the borehole at a linear speed (also called logging speed) related to the decay constant (or the half-life) of the gamma rays resulting from neutrons-$O_{16}$ atoms interaction (hereafter called "$O_{16}$ gamma rays"). Half-life of such gamma rays is about 7.13 seconds while half-life of gamma rays resulting from neutron-Si atoms interaction (or Al atoms) is 2.24 minutes (hereafter called "Si gamma rays"). After an elapsed time equal to a multiple (e.g. three) of the decay constant of the "$O_{16}$ gamma rays", the counting ratio of such gamma rays versus "Si gamma rays" is only 0.5%; said elapsed time is roughly 35 seconds. Owing to the distance separating source from detector (e.g. 140 inches), this gives a maximum logging speed of 1200 feet/hour. Theoretically, the lower the logging speed, the lower the above mentioned counting ratio. Nevertheless, the logging speed affects the "Si gamma ray" counts as shown on FIG. 4. This implies firstly not to decrease unduly the logging speed, and secondly to bring correction to the "Si gamma rays" count measurement as a function of the logging speed.

Not only does the invention allow one to make good quantitative measurements of the gravel pack quality, but it further allows one to locate, with accuracy, any gravel packed zone which has been emptied of original pack and refilled by formation; for example, in a well producing oil, the screen may have been damaged (for some reason), thus allowing the gravel pack surrounding the zone close to the damaged screen to be pulled away in the tubing along with the oil; this causes the formation to invade the space left free by the removed gravel pack; thus, in this zone (in the vicinity of damaged screen) the original gravel pack has been replaced by the formation. It is then very important to locate such a zone so as to make any suitable workover in the well.

Nevertheless, any prior art logging tool run in this well will give measurements subject to different interpretations. For example, if original gravel pack is made of bauxite (Al) and the formation surrounding the damaged screen is made of sand (Si), the prior art tools are not able to determine if the zone of interest is actually a bad quality zone or a zone with original pack removed and refilled with formation.

Figure 5:
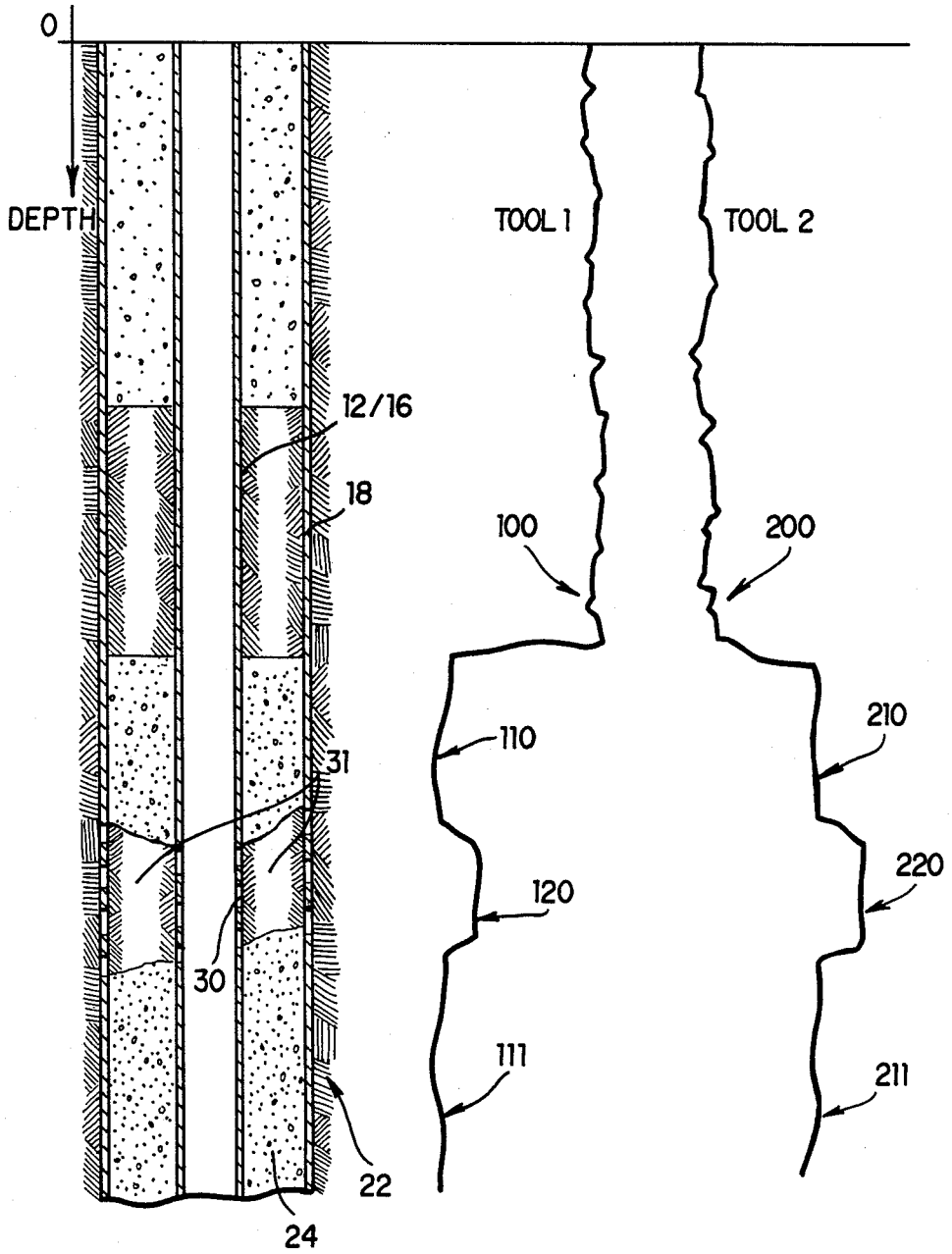
FIG. 5 shows schematic response in the form of logs of a combination of tools according to the invention.

According to a further aspect of the invention, there is provided a combination of a first tool, such as the above mentioned tool, with a second tool, known per se and such as the one described in U.S. Pat. No 4,587,423 and comprising a gamma ray source and a gamma ray detector. Although neither the first tool nor the second tool can, by itself, distinguish Si or Al from bad quality pack, the combination of both allows such a distinction. FIG. 5 shows schematically a well in which the original gravel pack 24 has been removed and pulled away, in a zone 31 placed in the vicinity of faults 30 in the screen 16; said zone 31 has been further filled by material from the formation. FIG. 5 also shows the respective logs derived from said first and second tools which have been run in this well Starting from the surface, the first log comprises a first portion 100 corresponding to the unpacked zone, and two second aligned portions 110, 111; said first log also shows a third portion 120 shifted with respect to said portions 110, 111 and indicative of the change of material in the refilled pack zone 31; this is due to the different "signatures" of Si and Al. In the same way, said second log shows a first portion 200 indicative of the unpacked zone, second aligned portions 210, 211 indicative of the presence of a pack, as well as a third portion 220 shifted with respect to first (200) and second (210, 211) portions and indicative of the change of material in the refilled pack zone 31. In the first log, said second portions 110, 111 are shifted with respect to first portion 100 in one direction (towards left side on FIG.5), while in the second log, said second portions 210, 211 are shifted with respect to first portion 200 in the opposite direction (towards right side on FIG.5); this implies that, on each log taken separately, any shift from left to right on the first log is representative of a decreasing pack quality, while it is representative of an increasing pack quality on the second log. Thus, on the first log taken by itself, said shifted third portion 120 could be interpreted as a partial void in the pack; just as on said second log taken by itself, said shifted third portion 220 could be interpreted as being representative of a good pack quality zone, and the second potions 210, 211 as being representative of a bad quality pack zone (including voids). According to the invention, the combination of the said first and second logs from respectively said first and second tools allows one to locate the gravel packed zone in the vicinity of the damaged screen zone.

Although the invention has been described herein with reference to a specific embodiment thereof, it will be understood that such embodiment is susceptible of variation and modification without departing from the inventive concepts disclosed. All such variations and modifications, therefore, are intended to be included within the spirit and scope of the appended claims.

I claim:

1. A method for investigating a gravel pack located in the annulus between the tubing/screen and the casing of a borehole, comprising the steps of:

moving a logging tool through the tubing/screen over the depth region of the gravel pack, said logging tool including a neutron source able to emit neutrons at such an energy that their interaction with a first set of atoms indicative of the gravel pack quality causes the production of gamma rays, and at least one gamma ray detector; and deriving a measurement of the number of gamma rays resulting from the interaction of said neutrons and said first set of atoms of the gravel pack material, and which are detected by said detector over a predetermined counting time interval.

2. A method according to claim 1, wherein said first set of atoms includes silicon (Si).

3. A method according to claim 1, including the step of moving the tool in the well at a speed related to the half life of the gamma rays characteristic of a second set of atoms non representative of the gravel pack, the influence of said second set of atoms having to be minimized in the total count of gamma rays related to said first and second sets of atoms.

4. A method according to claim 3, in which said second set of atoms includes oxygen ($O_{16}$) atoms.

5. A method according to one of claims 1 or 3, wherein said interaction is of the activation type, where emitted neutrons transmute the nucleus of atoms of said first set in an unstable isotope which in turn decays back to a stable state while emitting gamma rays.

6. A method according to claim 1 wherein said first set of atoms includes aluminum (Al) atoms.

7. A method for investigating a gravel pack located in the annulus between the tubing/screen and the casing of a borehole, comprising the steps of:

(a) moving a first logging tool, including a neutron source adapted to emit neutrons at such an energy that their interaction with a first set of atoms of gravel pack material produces gamma rays, and at least one first gamma ray detector, through the tubing/screen over the depth region of the gravel pack;

(b) deriving a first measurement of the number of gamma rays resulting from the interaction of said neutrons and said first set of atoms of the gravel pack material, and detected by said first detector over a predetermined count time interval;

(c) moving a second tool through the tubing/screen over the depth region of the gravel pack, said second logging tool including a gamma ray source adapted to emit gamma rays able to interact with said first set of atoms so that said emitted gamma rays are deviated and redirected, and at least a second gamma ray detector;

(d) deriving a second measurement of the number of gamma rays deviated and redirected following their interaction with said first set of atoms, and detected by said second gamma ray detector; and (e) comparing said first and second measurements.

8. A method according to one of claims 1 or 7, wherein said neutron source is of the electronic type.

9. A tool for investigating a gravel pack located in the annulus between the tubing/screen and the casing of a borehole, comprising:

a neutron source adapted to emit neutrons at such an energy that their interaction with a first set of atoms indicative of the gravel pack generates gamma rays;

at least one gamma ray detector; and means for deriving a measurement of the number of gamma rays resulting from the interaction of said neutrons and said atoms of the gravel pack material, and which are detected by said detector over a predetermined counting time interval.

10. A tool according to claim 9, wherein said interaction is of the activation type, where emitted neutrons transmute the nucleus of atoms of said first set in an unstable isotope which in turn decays back to a stable state while emitting gamma rays.

11. A tool according to claim 9, wherein said neutron source is of the electronic type.

* * * * *